US006679682B2

(12) United States Patent
Lee

(10) Patent No.: US 6,679,682 B2
(45) Date of Patent: Jan. 20, 2004

(54) TURBOFAN IN AIR CONDITIONER

(75) Inventor: Nee Young Lee, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/945,625

(22) Filed: Sep. 5, 2001

(65) Prior Publication Data

US 2002/0028138 A1 Mar. 7, 2002

(30) Foreign Application Priority Data

Sep. 5, 2000 (KR) ..... 2000-52277
Sep. 5, 2000 (KR) ..... 2000-52278
Apr. 20, 2001 (KR) ..... 2001-21435

(51) Int. Cl.[7] ..... F04D 29/30
(52) U.S. Cl. ..... 415/206
(58) Field of Search ..... 415/206, 208.1, 415/211.1, 173.6, 173.1; 416/186 R

(56) References Cited

U.S. PATENT DOCUMENTS 4,120,170 A 10/1978 Whitwell et al.
4,394,111 A 7/1983 Wiese et al.
4,669,534 A 6/1987 Maeda et al.
5,967,748 A 10/1999 Jang
6,032,479 A 3/2000 Choi et al.
6,042,335 A * 3/2000 Amr ..... 415/208.1

FOREIGN PATENT DOCUMENTS

EP 0 791 788 A2 8/1997
EP 0 926 452 A1 6/1999
EP 0 971 131 A2 1/2001
FR 2 772 437 A1 6/1999

* cited by examiner

*Primary Examiner*—Edward K. Look
*Assistant Examiner*—Kimya N McCoy
(74) *Attorney, Agent, or Firm*—Birch, Stewart, Kolasch & Birch, LLP

(57) ABSTRACT

An object of the present invention is to provide a turbofan in an air conditioner, which facilitates unitary formation of a turbofan, and easy formation of a turbofan mold, and has a longer lifetime of the mold.

Another object of the present invention is to provide a turbofan in an air conditioner, which can minimize noise produced during operation of the turbofan.

To achieve these and other objects of the present invention, there is provided a turbofan in an air conditioner including a base plate having a hub at a center thereof for coupling to a shaft of a driving motor, a plurality of blades disposed at a periphery of the base plate at fixed intervals along a circumferential direction, and a shroud including an inlet side end part formed in parallel to the shaft, and fitted to ends of the blades 40 to connect the ends, having an inside diameter equal to, or greater than an outside diameter of the base plate, a shoulder part extended outward in a radial direction from an inside circumference of the inlet side end part, and a sloped part extended outward in a radial direction, and sloped downward, from an end of the shoulder part.

16 Claims, 13 Drawing Sheets

TURBOFAN IN AIR CONDITIONER

BACKGROUND OF THE INVENTION

1. Field of the Invention

The present invention relates to an air conditioner, and more particularly, to an improved turbofan in an air conditioner.

2. Background of the Related Art

FIG. 1 illustrates a perspective disassembled view of a related art window air conditioner, referring to which the related art window air conditioner will be explained.

There is a front grill 3 at a front face (indoor side) of a base pan 1, a bottom of the air conditioner. The front grill 3 is provided with an inlet 3*i* in a lower part thereof for drawing room air, and an outlet grill 3*e* in an upper part thereof for discharging the air heat exchanged in the air conditioner into the room, again. There is an inlet grill (not shown) provided to the inlet 3*i*, and a filter (not shown) between the inlet grill and the inlet 3*i*.

There is an air guide 7 at an inner side of the front grill 3 provided with a room heat exchanger 5, for cooling the air drawn through the inlet 3*i* by heat exchange between working fluids in an air conditioning cycle. The air guide 7 is fitted to an upper surface of the base pan 1, and partitions the air conditioner into an indoor side and an outdoor side. That is, the indoor side and the outdoor side are isolated by the air guide 7 to cut off air circulation between the two. The air guide 7 has a shaft hole 7' for pass of a shaft of a motor 15 for rotating the sirocco fan 13. There is also a brace 7B at a top of the air guide 7 formed as a unit with the air guide 7 for fastening to a shroud 18 of a fan. The air guide 7 has a control box hold 8 formed as one unit with the air guide 7 at one side thereof for holding a control box (not shown) therein. There is a scroll 9 fitted in the air guide 7. The scroll 9 has a flow guide surface 9*g* form inside thereof with a required curvature from one side to the other side. There is an orifice 11 fitted in front of the scroll 9, with an orifice hole 12 for guiding the air flowing through the indoor heat exchanger 5 toward the sirocco fan 13. There is an outlet guide 11*e* formed as a unit with the orifice 11 at a top of the orifice 11 for guiding the heat exchanged air toward the outlet grill 3*e*. A back of middle part of the outlet guide 11*e* is opened, at both ends of which opening coupling parts 11' are formed for coupling with the top of the air guide 7. There is a finger guide 'F' at a back of the outlet guide 11*e* for cutting off access to the sirocco fan 13 from an outside. There is a projection 'E' formed of ESP at one side of the outlet guide 11*e* for preventing the white scroll 9 from being seen from outside. Since the outlet guide 11*e* is formed above the orifice 11, the orifice 11 is inserted between the indoor heat exchanger 5 and the sirocco fan 13 from above. That is, the orifice 11 is assembled in a top-down method. The sirocco fan 13 fitted in the scroll 9 makes room air to flow through the inlet 3*i*, the indoor heat exchanger 5, and the orifice hole 12. The sirocco fan 13 draws air through the orifice 12, and leads the air to flow in a circumferential direction thereof along the flow guide surface 9*g* to the outlet guide 11*e*.

The explanation made up to now is on the indoor side of the window air conditioner, and the outdoor side of the window air conditioner will be explained.

There is a motor 15 in the outdoor side (rear side) of the air guide 7 for rotating the sirocco fan 13 and the fan 17. The motor 15 has a shaft projected in front and back thereof, one of which is passed through the air guide 7, projected up to a center of the scroll 9, and coupled with the sirocco fan 13. The fan 17 is coupled to the outdoor side shaft of the motor 15. The fan 17 draws air from outside of the air conditioner, and makes the air to pass through the indoor heat exchanger 19. The fan 17 has a ring 17*r* connected at ends of blades. There is a fan shroud 18 fitted on the base pan 1 for guiding air flow formed by the fan 17, having an opening 18' in communication with an outdoor heat exchanger 19 side for fitting the fan 17 therein. There is an outdoor heat exchanger 19 on outdoor side of the base pan 1 opposite to the fan shroud 18. Though not shown, there are a compressor and an expansion valve and the like, elements of the air conditioning cycle, on the outdoor side. Lastly, the different components of the air conditioner are enclosed by an outer case 20. The outer case 20 forms an outer appearance of the air conditioner. The window air conditioner is installed such that the indoor side of the window air conditioner is in an air conditioning space, and the outdoor side is in the outdoor.

The operation of the air conditioner will be explained.

Upon putting the air conditioner into operation, the air conditioning cycle is activated, as the motor 15 rotates the sirocco fan 13 and the fan 17. According to this, indoor side air is provided to the indoor heat exchanger 5 through the inlet 3*i*. The air heat exchanges with a working fluid as the air passes through the heat exchanger 5, to be cooled down to a relatively low temperature. The heat exchanged air is provided to the sirocco fan 13 through the orifice hole 12. The air drawn into the sirocco fan 13 is guided in the circumferential direction of the sirocco fan 13, until the air is discharged therefrom, guided along the flow guide surface 9*g* of the scroll 9, lead to the outlet guide 11*e*, and discharged to the air conditioning space again through the outlet grill 3*e*.

On the other hand, in the outdoor side, an operation for discharging a heat, the working fluid is received at the indoor heat exchanger 5, is in process. That is, external air is drawn by the fan 17, heat exchanged with the outdoor heat exchanger 19, for discharging the heat to outside of the room.

However, the related art window air conditioner has the following problems.

First, the sirocco fan 13, used for drawing the room air, is designed for handling a large volume of air, has numerous short blades each having a curvature opposite to a direction of rotation to require a separate air guide structure, the scroll 9, for forming an air flow. However, the use of a scroll causes various problems. In detail, the air is discharged in the circumferential direction of the sirocco fan 13 throughout the flow guide surface 9*g*. Therefore, the air discharged upstream of the flow guide surface 9*g* flows along the flow guide surface 9*g*, to build up a higher air pressure as the air flows downstream and creates an increasing resistance against the rotation of the sirocco fan 13. Moreover, since the air is concentrated toward the downstream of the flow guide surface 9*g*, the air flow is concentrated on one side of the outlet guide 11*e*. At the end, in view of the whole outlet grill 3*e*, the air is not uniformly discharged from the outlet grill 3*e*. Accordingly, in order to solve the shortcomings of the sirocco fan designed for handling a large volume of air, a technology is suggested, in which a high efficiency turbofan is employed for forming an indoor air flow.

An example of a related art turbo fan will be explained with reference to FIGS. 2, 3A, and 3B.

The related art turbo fan is provided with a base plate 32 of a circular disc having a hub 38 at a center thereof for coupling with a shaft of a motor, a plurality of blades 34 fitted along a circumference of the base plate 32, and a shroud 36 formed as a unit with the blades 34. The blade 34 has a blade exit angle β2 smaller than 90°, a ratio of inside/outside diameters smaller than 0.8, a backward curved form, and an inlet width W1 into which the air is started to be introduced thereto smaller than an outlet width W2. The shroud 36 is annular to connect all blades 34 at the smaller side widths of the blades 34. The shroud 36 guides the air flowing along the blade 34, and makes the air flowing between adjacent blades discharged from the blades 34 at a required pressure. A blade inlet angle β1 on the hub 38 and the blade exit angle β2 on the shroud side 36 may differ for producing a uniform flow between the blades 34, and improve noise characteristics. As the turbofan requires no additional flow guide surface in view of operation of the turbofan, the turbofan facilitates omission of the scroll 9 in FIG. 9, to permit a simplified overall structure of the air conditioner.

A process for fabricating the related art turbofan will be explained. The base plate 32 and the blades 34 are injection molded of plastic as one unit, and the shroud 36 is also injection molded of plastic separate from the base plate and the blades. The shroud 36 is then fusion welded to the blades 34 by an ultrasonic wave.

However, a structure of the foregoing related art turbofan has the following shortcoming. At first, the structure of the related art turbofan does not permit a unitary injection molding of the shroud 36, the base plate 32, and the blades 34, 50 as to require the shroud 36 formed as a separate unit to weld onto the unitary base plate 32 and the blades 34 by ultrasonic wave, of which alignment of the two units for the welding is not easy to cause a high defect ratio. Because an exact alignment of the two units before the welding, as well as prevention of misalignment caused by vibration, and deformation of the blades 34, during the welding are required, elimination of defects in the fabrication process has not been easy. Also, there has been a burden of expense for providing an expensive equipment, such as an ultrasonic welder, for fabrication of the related art turbofan, that pushes up a production cost of the turbofan.

Referring to FIG. 3B, the related art turbofan has the outlet width W2 smaller than the inlet width W1, implying that a flow area ratio of the discharged air by the blade 34 differ at the inlet and the outlet, i.e., the flow area of the discharge air becomes the smaller as it goes from the inlet to the outlet of the blade 34. Such a difference of the flow areas of the blade 34 also induces a difference of discharge air pressures, to cause imbalance of the pressures, that in turn causes flow noise.

In the meantime, FIG. 4 illustrates a structure of turbofan that overcomes a structural limitation that the shroud 36 and the base plate 32 and the blades 34 can not be injection molded as a unit, one of problems of the related art turbofan.

Referring to FIG. 4, the turbofan is provided with a base plate 42 having a boss 41 at a center thereof for coupling with a shaft (not shown) of a motor, and a plurality of blades 43 formed in a radial direction centered on the boss 41 along a periphery of the base plate 42. There is a shroud 44 at a side of the blades 43 opposite to the base plate 42. The shroud 44 has an inside diameter D1 equal to, or greater an outside diameter D2 of the base plate 42, and an inlet side end 44*a* parallel to a shaft direction.

Referring to FIG. 5, the foregoing structure is provided, for preventing interferences between molds when an upper mold 'A' and a lower mold 'B' are separated along a parting line 'G', thereby forming the boss 41, the base plate 42, and the shroud 44 at the same time as one unit. The shroud 44 is curved outward as it goes from the inlet side end 44*a* to the outlet of the blades 43, to form a curved part 44*b* as shown in FIG. 4.

However, the foregoing related art turbofan has the following problems.

First, a depth of a step 44*c* formed in a radial direction in an inside circumference of the inlet side end 44*a* can not be smaller than a radial direction thickness 't' of the shroud 44. A turbofan formed thicker than a certain limit (for an example, 4 mm) pushes up cost, and has a poor quality due to shrinkage during formation, so as to form the turbofan below a certain thickness. Accordingly, for an example, if the thickness of the turbofan is 4 mm, the depth β of the step 44*c* is only 1 mm–2 mm. Thus, the depth β of the step 44*c* can not be smaller than the thickness of the turbofan. Although the injection molding is done well initially, a burr may be formed at the step 44*c* of the turbofan after completion of the injection molding since a part of the lower mold for the step 44*c* wears down to form a sharp edge after a prolonged use of the mold. That is, a lifetime of the mold is shortened due to the easy wear down of the part for the step 44*c* of the turbofan. Moreover, since the depth of the step 44*c* is smaller than the radial direction thickness 't' of the shroud 44, formation of the mold is not easy.

In the meantime, referring to FIG. 6, the foregoing related art turbofan has an unstable flow characteristics because of vortices formed on outer side of the curved shroud 44, that causes noise if a difference of discharge flow speeds coming from the form of the shroud 44 affects an air flow and turbulence inside of the casing 51.

SUMMARY OF THE INVENTION

Accordingly, the present invention is directed to a turbofan in an air conditioner that substantially obviates one or more of the problems due to limitations and disadvantages of the related art.

An object of the present invention is to provide a turbofan in an air conditioner, which facilitates unitary formation of a turbofan, and easy formation of a turbofan mold, and has a longer lifetime of the mold.

Another object of the present invention is to provide a turbofan in an air conditioner, which can minimize noise produced during operation of the turbofan.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the turbofan in an air conditioner includes a base plate having a hub at a center thereof for coupling to a shaft of a driving motor, a plurality of blades disposed at a periphery of the base plate at fixed intervals along a circumferential direction, and a shroud including an inlet side end part formed in parallel to the shaft, and fitted to ends of the blades to connect the ends, having an inside diameter equal to, or greater than an outside diameter of the base plate, a shoulder part extended outward in a radial direction from an inside circumference of the inlet side end part, and a sloped part extended outward in a radial direction, and sloped downward, from an end of the shoulder part.

The base plate includes a central part having the hub formed like a cap so that the central part is disposed closer to an inlet compared to a bottom part thereof on an outer side of the central part, and a connecting part between the central part having the hub and the bottom part having a plurality of openings along a circumference thereof.

Preferably, the connecting part is parallel with a direction of the shaft, wherein a part where the central part and the connecting part meet is curved.

The shoulder part has at least a 4 mm width.

According to the first aspect of the present invention, an air flow through the turbofan is made smooth to reduce noise relative to other forms of turbofan having the same air flow rate, and a lifetime of a mold is prolonged as formation of the mold is easy and wear can be inhibited. Moreover, unitary formation of the entire turbofan at one time by injection molding is made possible.

In other aspect of the present invention, there is provided a turbofan in a window air conditioner including a base plate having a hub at a center thereof for coupling to a shaft of a driving motor, a plurality of blades disposed on an outside circumference of the base plate at fixed intervals along a circumferential direction, and a shroud fitted to ends of the blades.

The outside circumference of the base plate fitted to inside surface of the blades is fitted to the blades in a state the outside circumference of the base plate is bent forward or backward of the turbofan.

The outside circumference of the base plate is bent forward or backward of the turbofan by 90°.

The inside surfaces of the blades fitted to the shroud are positioned nearer to a center side of the turbofan than an inside circumference of a fore end of the shroud.

According to the other aspect of the present invention, since there is no overlapped part between the shroud and the base plate, unitary formation of the entire turbofan at a time by injection molding is made possible, and an adequate width of the connecting part connecting outside circumference of the base plate and inside surface of the blade can be secured. Moreover, since unitary formation of the entire turbofan at a time by injection molding is made possible, formation of the mold becomes easy, and a lifetime of the mold is prolong as wear of the mold can be inhibited.

In another aspect of the present invention, there is provided a turbofan in a window air conditioner including a base plate having a hub at a center thereof for coupling to a shaft of a driving motor, a plurality of blades each having identical inlet width and outlet width disposed at a periphery of the base plate along a circumferential direction, and a shroud fitted to ends of the blades.

The shroud includes a connecting part for connecting a turbofan front side fore end of each blade, and a shoulder part extended perpendicular to the connecting part from an inside end of the connecting part toward a front side of the turbofan.

The connecting part of the shroud is fitted to an entire fore end of the blade, or only to a part of the fore end of the blade.

According to another aspect of the present invention, since there is a uniform air pressure from a blade inlet to a blade outlet, to make a pressure balance, air flow noise is suppressed to the maximum.

The unitary formation of the entire turbofan by injection molding permitted by another aspect of the present invention facilitates an easy formation of the mold, and inhibits wear of the mold, to prolong a lifetime of the mold.

In further aspect of the present invention, there is provided a turbofan in a window air conditioner including a base plate projected forward to the shroud side in two stages having a hub at a projected center thereof for coupling to a shaft of a driving motor, a plurality of blades each having identical inlet width and outlet width disposed at a periphery of the base plate at fixed intervals along a circumferential direction, and a shroud fitted to ends of the blades.

According to the further aspect of the present invention, shaft direction widths of the turbofan and the motor can be reduced, to secure a larger space for adjacent components to give more freedom in arranging and designing the adjacent components.

The unitary formation of the entire turbofan by injection molding permitted by further aspect of the present invention facilitates an easy formation of mold, and inhibits wear of the mold, to prolong a lifetime of the mold.

The blade in different aspect of the present invention has a streamlined or planar section.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 11(*b*) illustrates a section of a turbofan for use in a window air conditioner in accordance with the second preferred embodiment of the present invention;

DETAILED DESCRIPTION OF THE PREFERRED EMBODIMENT

Figure 7:
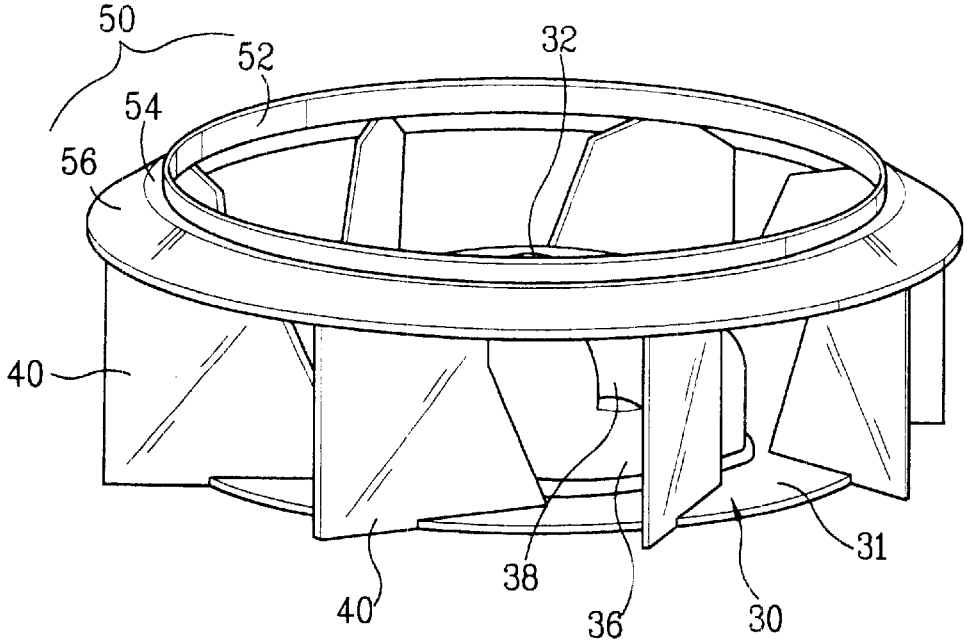
FIG. 7 illustrates a perspective view of a turbofan for use in a window air conditioner in accordance with a first preferred embodiment of the present invention.
Figure 8:
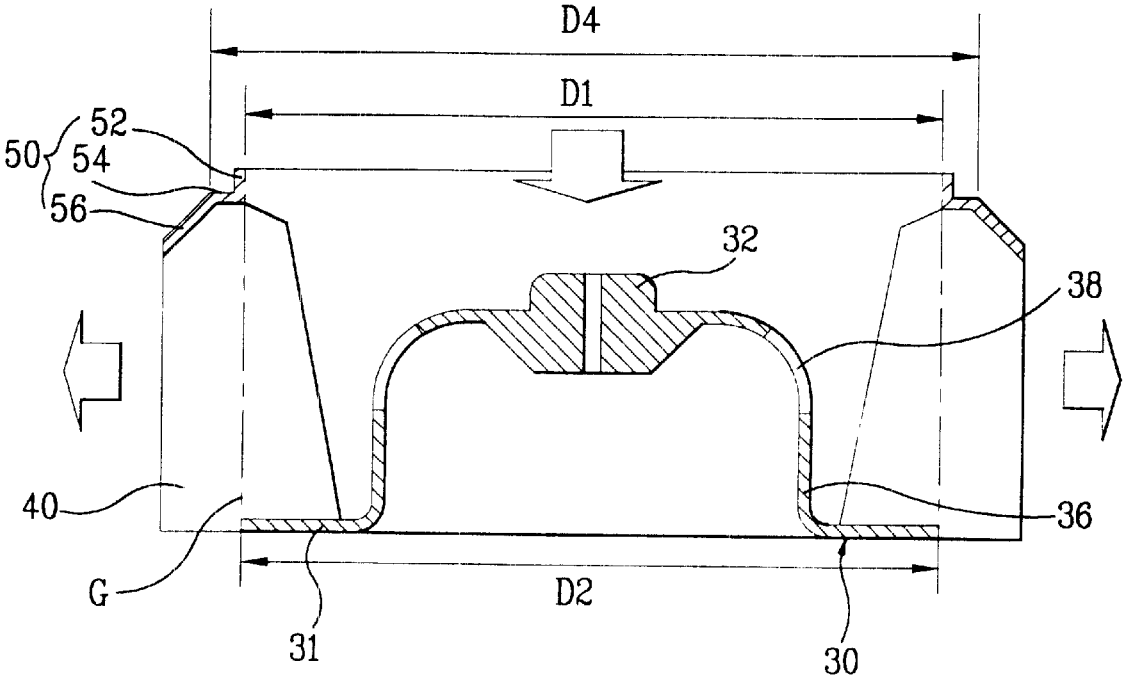
FIG. 8 illustrates a section of the turbofan in FIG. 7.
Figure 9:
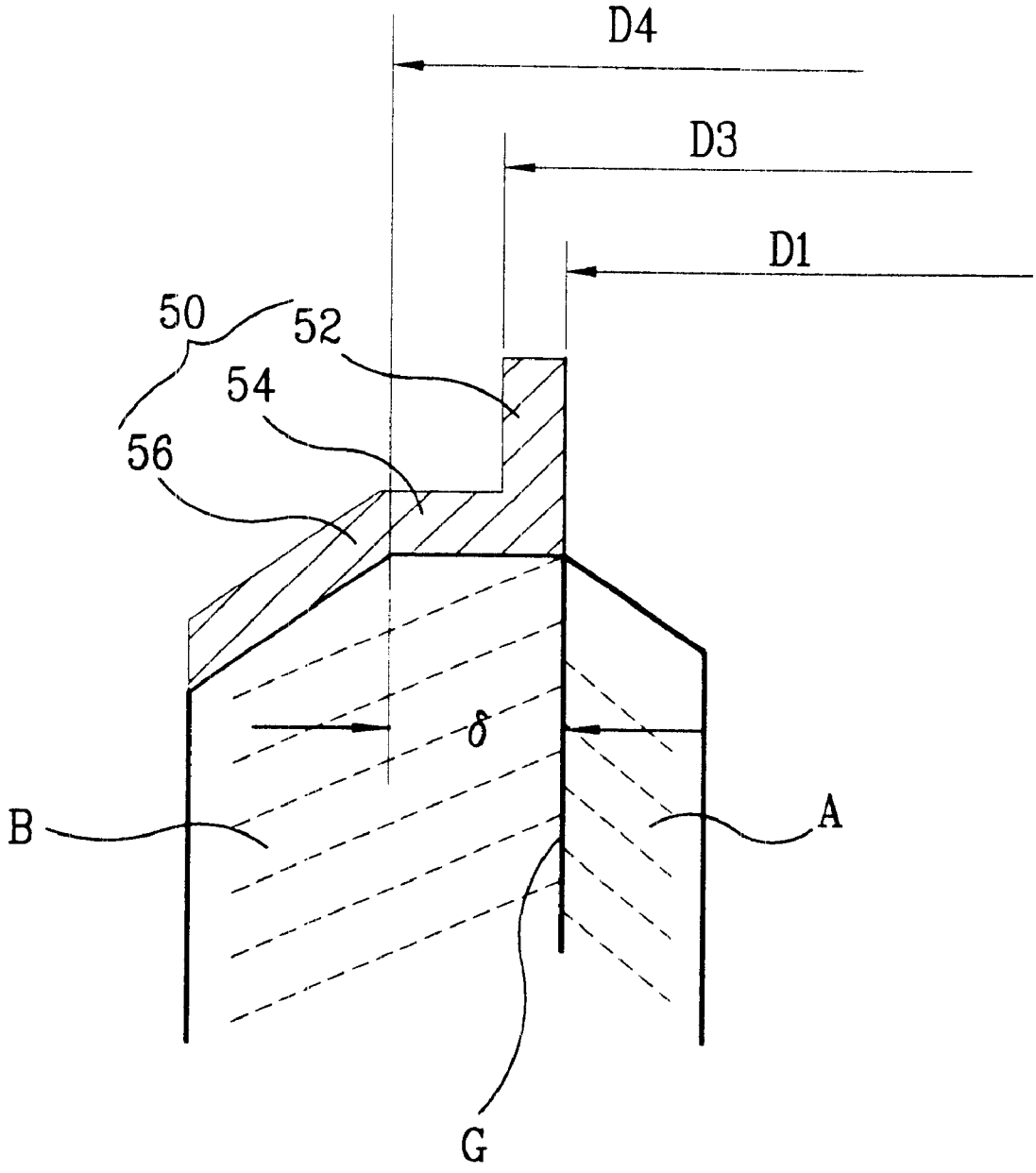
FIG. 9 illustrates an enlarged view of key parts of the turbofan in FIG. 7.
Figure 10:
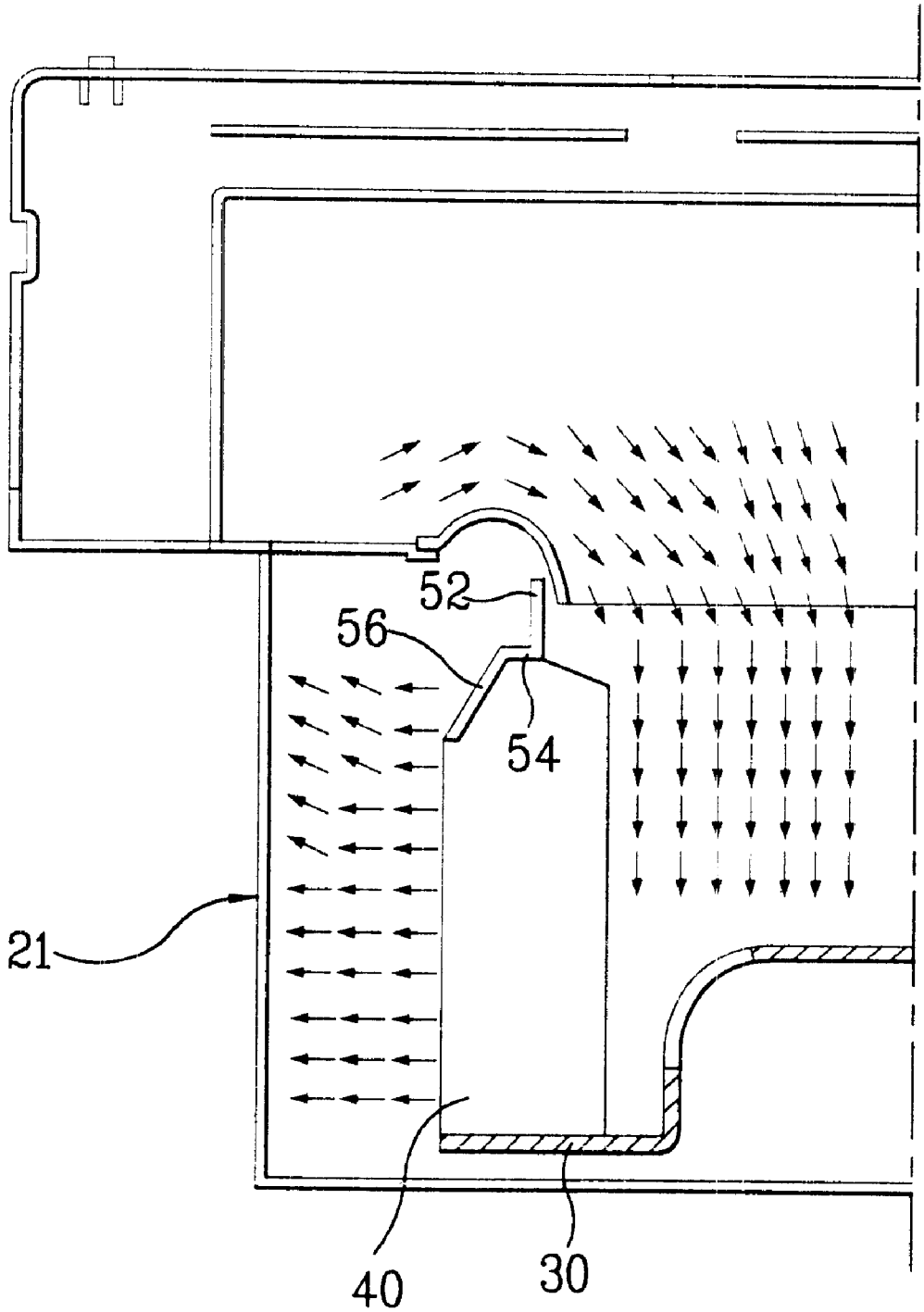
FIG. 10 illustrates a section showing an air flow when the turbofan in accordance with a first preferred embodiment of the present invention is applied thereto.

Reference will now be made in detail to the preferred embodiments of the present invention, examples of which are illustrated in the accompanying drawings. A turbofan in a window air conditioner in accordance with a first preferred embodiment of the present invention will be explained, with reference to FIGS. 7–10. FIG. 7 illustrates a perspective view of a turbofan for use in a window air conditioner in accordance with a first preferred embodiment of the present invention, FIG. 8 illustrates a section of the turbofan in FIG. 7, FIG. 9 illustrates an enlarged view of key parts of the turbofan in FIG. 7, and FIG. 10 illustrates a section showing an air flow when the turbofan in accordance with a first preferred embodiment of the present invention is applied thereto.

The turbofan in a window air conditioner in accordance with a first preferred embodiment of the present invention includes a base plate 30 having a hub 32 at a center thereof for coupling to a shaft of a driving motor, a plurality of blades 40 disposed at a periphery of the base plate 30 at fixed intervals along a circumferential direction, and a shroud 50 having an inlet side end part 52 formed in parallel to the shaft, fitted to ends of the blades 40 to connect the ends, with an inside diameter D1 equal to, or greater than an outside diameter D2 of the base plate 30, a shoulder part 54 extended outward in a radial direction from an inside circumference of the inlet side end part 52, and a sloped part 56 extended outward in a radial direction, and sloped downward, from an end of the shoulder part 54.

The base plate 30 has a central part with the hub 32 formed like a cap so that the central part is disposed near to an inlet compared to a bottom part 31 thereof on an outer side of the central part, for balancing a weight of the turbofan, wherein a connecting part 36 between the central part having the hub 32 and the bottom part 31 has a plurality of openings 38 along a circumference thereof for smooth discharge of a heat generated at the motor. It is preferable that a part the central part with the hub and the connecting part meet is curved, while the connecting part 36 is parallel to the shaft. A width of the shoulder part 54 of the shroud 50 is designed to be at least 4 mm.

A mold for forming the turbofan in accordance with a first preferred embodiment of the present invention, and works of the turbofan formed from the mold will be explained.

The base plate 30, the blades 40, and the shroud 50 of the turbofan of the present invention are formed as one unit. A part that causes the greatest problem in the molds 'A' and 'B' of the foregoing structured turbofan is the shroud part 50. Therefore, as shown in FIG. 9, the upper mold 'A' is fitted such that the upper mold 'A' can be drawn through an inside diametral surface of the inlet side end part 52 of the shroud 50 after the turbofan is formed, and the lower mold 'B' is fitted such that the lower mold 'B' can be drawn to a lower side of the shoulder part 54 and the sloped part 56 along an out side diameter of the base plate 30 after the turbofan is formed. That is, a parting line of the molds is either on an outside diameter D2 of the base plate 30, or on an inside circumference of the inlet side end part 52 which has a greater diameter than the outside diameter D2.

Thus, the first preferred embodiment of the present invention permits the entire turbofan to be formed as one unit by one injection molding, since there is no overlapped part between the shroud 50 and the base plate 30, minimizing the defect ratio occurring in formation of the turbofan and improving productivity.

Moreover, the hub 32 on the base plate 30 disposed at a center part both in an axis direction and the radial direction can balance the turbofan, to allow stable and safe dismantling of the mold in formation of the turbofan, that prevents distortion of the turbofan. Moreover, the hub 32 at a center both in the axis direction and the radial direction permits to maintain balance when the hub is coupled to the shaft of the motor, such that the turbofan rotates accurately without eccentricity, which reduces vibration and noise.

In the meantime, the shroud 50 has the inlet side end part 52 parallel to the rotation axis, the shoulder part 54 extended outward from the inlet side end part 52 parallel to the base plate 30, and the sloped part 56 extended outward, and sloped with respect to the base plate 30, from a fore end the shoulder part 54. That is, the shoulder part 54 is annular with a depth δ outwardly from the inlet side end part 52, to form a diameter D4 of an outer end of the shoulder part to be at least greater than an outside diameter D3 of the inlet side end part 52 of the shroud 50.

Referring to FIG. 10, the turbofan in accordance with a first preferred embodiment of the present invention has flow characteristics as shown in FIG. 10 owing to this configuration and resulting in reduced noise. That is, a noise caused by turbulence occurring at the shroud 50 is reduced. FIG. 10 illustrates an LDV experiment for visualizing a flow characteristic of the turbofan of the present invention, wherein a size of the turbulence occurring at the shroud 50 of the turbofan and characteristics of a discharge flow are shown. That is, the turbofan in accordance with a first preferred embodiment of the present invention has good air flow characteristics, and especially, no vortex at the discharge side as shown in FIG. 10 owing to a configuration of the shroud 50. Therefore, in comparison to the related art, the turbofan of the present invention has lower noise if the air flow rates are the same. The greater depth 'δ' of the shoulder part 54, which leads a width of a part of the lower mold 'B' for the shoulder 54 to be greater too, not only facilitates an easier fabrication of the molds 'A' and 'B' than the related art, but also inhibits wear to prolong the lifetime of the molds and the turbofan. That is, since the first embodiment turbofan of the present invention can reduce noise for the same air flow rate, permit an easy formation of the molds, and inhibit wear relative to the related art, a lifetime of the molds can be increased.

Figure 11A:
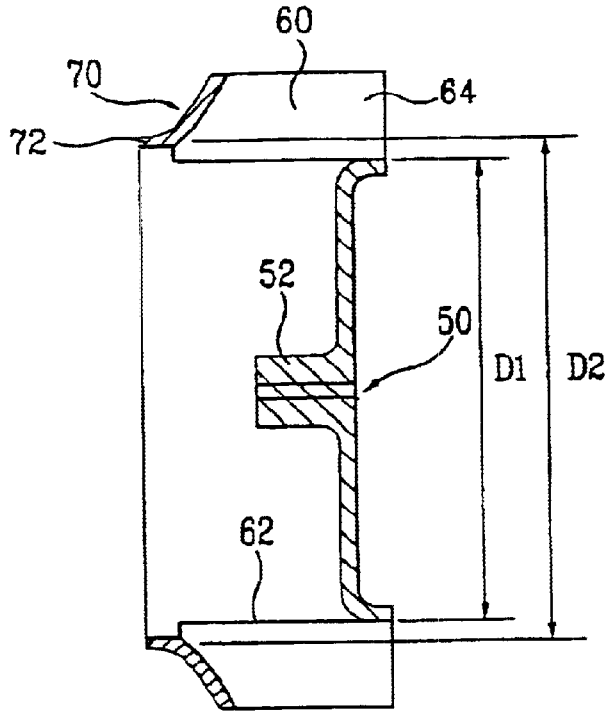
FIG. 11(*a*) illustrates a section of a turbofan for use in a window air conditioner in accordance with a second preferred embodiment of the present invention.
Figure 11B:
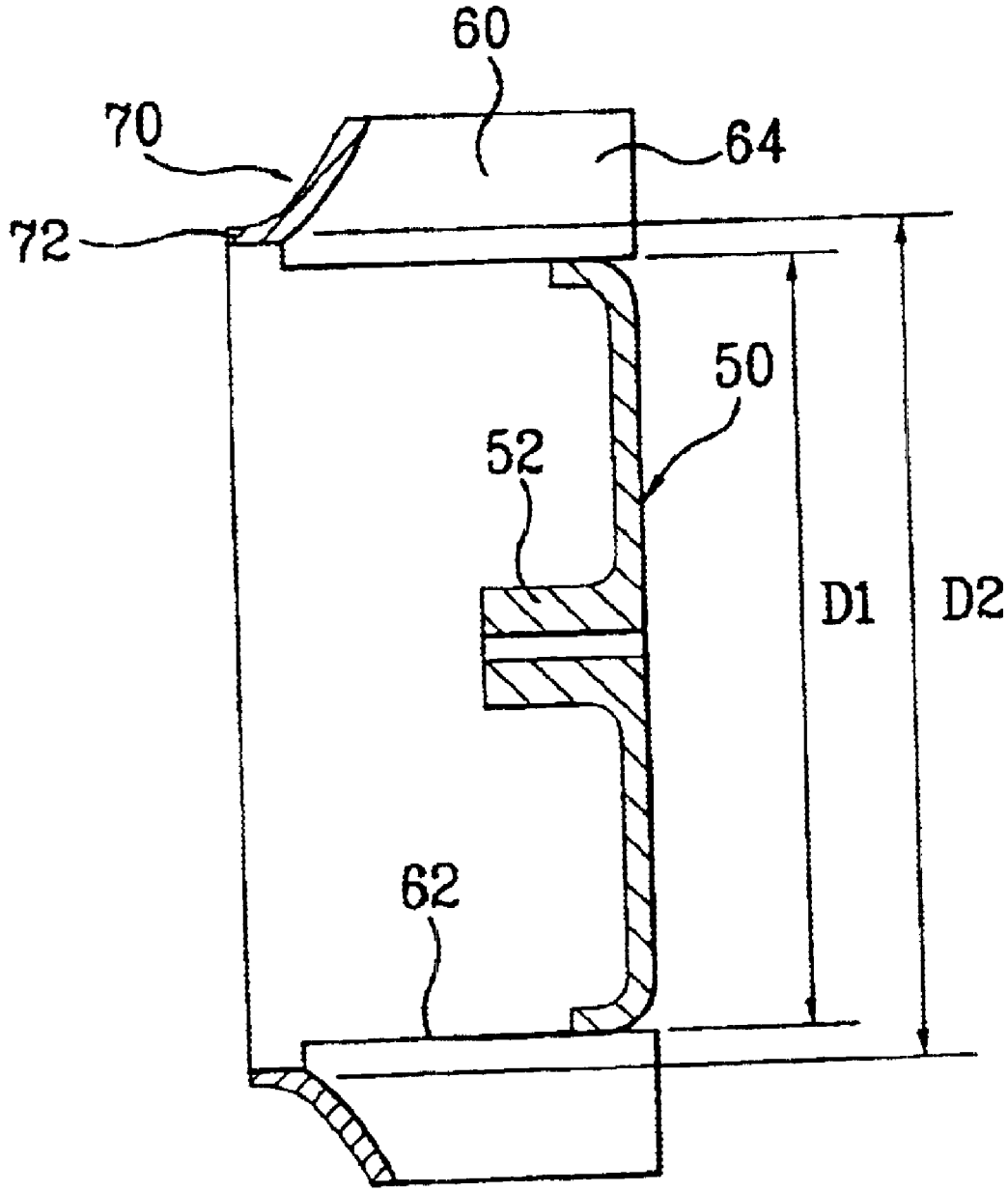

A turbofan in a window air conditioner in accordance with a second preferred embodiment of the present invention will be explained, with reference to FIG. 11. FIG. 11 illustrates a section of a turbofan in a window air conditioner in accordance with a second preferred embodiment of the present invention.

Referring to FIGS. 11(*a*) and (*b*), the turbofan in a window air conditioner in accordance with a second preferred embodiment of the present invention includes a base plate 50 having a hub 52 at a center thereof for coupling to a shaft of a driving motor, a plurality of blades 60 disposed on an outside circumference of the base plate 50 at fixed intervals along a circumferential direction, and a shroud 70 fitted to ends of the blades 60. The outside circumference of the base plate 50 fitted to the inside of each of the blades 60 is bent to rear of the turbofan where the motor is fitted.

Particularly, it is preferable that the outside circumference 54 of the base plate 50 is bent to the rear side of the turbofan by 90°. The inside surface 62 of the blade 60 meeting with the shroud 70 is disposed nearer to a shaft center of the turbofan than the inside circumferential surface of a fore end of the shroud 70.

The turbofan in accordance with a second preferred embodiment of the present invention permits an entire turbofan to be formed as one unit by one injection molding, because a diameter D2 of an inside circumferential surface of a fore end 72 of the shroud 70 is greater than a diameter D1 of an inside surface 62 of the blades 60, without any overlapped parts of the shroud 70 and the base plate 50. Therefore, a defect ratio occurring in formation of turbofans is minimized and productivity can be improved. The turbofan in accordance with a second preferred embodiment of the present invention also permits an easy formation of the mold, and inhibits wear to prolong a lifetime of the mold. Since the diameter D2 of the inside circumferential surface of the fore end 72 of the shroud 70 is greater than a diameter D1 of the inside surface of the blades 60, enough air can be drawn. That is, since the diameter D2 of the inside circumferential surface of the fore end 72 of the shroud 70, which has a function of an air suction opening in the turbofan, is greater than the diameter D1 of the inside surface 62 of the blades 60, the air suction opening is made larger, to increase an air suction rate. The second embodiment shroud 70 may be fixed to the blades 60 by welding, or by using separate fastening members.

As explained, basically, the turbofan in accordance with a second preferred embodiment of the present invention suggests fitting of a plurality of blades 60 to an outside circumferential surface of a base plate 50. Moreover, in the embodiment shown, the outside circumferential surface 54 of the base plate 50 is fitted to the inside surface 62 of the blade 60 in a form bent to rear of the turbofan. However, since the turbofan in accordance with a second preferred embodiment of the present invention basically suggests fitting of a plurality of blades 60 to an outside circumferential surface of a base plate 50, the turbofan in accordance with a second preferred embodiment of the present invention is not limited to a form shown in FIG. 11(*a*). For an example, different from one shown in FIG. 11(*a*), the outside circumference of the base plate 50 may be bent forward of the turbofan opposite to the one shown in FIG. 11(*a*), e.g., as seen in FIG. 11(*b*), and fits to the inside surfaces 62 of the blades 60. The fitting of the outside circumference 54 of the base plate 50 to the inside surfaces 62 of the blades 60 in a state the outside circumference 54 of the base plate 50 is bent forward or backward of the turbofan permits to secure an adequate width of the connection part for connection of the outside circumference 54 of the base plate 50 and the inside surfaces of the blades 60. However, different from the foregoing turbofans, the outside circumference 54 of the base plate 50 may be fitted to the inside surfaces 62 of the blades 60 in a state the base plate 50 is formed planar without bending the outside circumference 54, when it is preferable that a lower end surface of the blade 60 is disposed on the same plane with a bottom surface of the base plate 50.

Moreover, alike the first embodiment, in the turbofan in accordance with a second preferred embodiment of the present invention, since the hub 52 for balancing the turbofan is disposed near to a center of the turbofan along an axis direction, the dismantling of the mold is easy in the formation of the turbofan, and the vibration and noise occurred during operation of the turbofan caused by eccentricity can be reduced.

Figure 12:
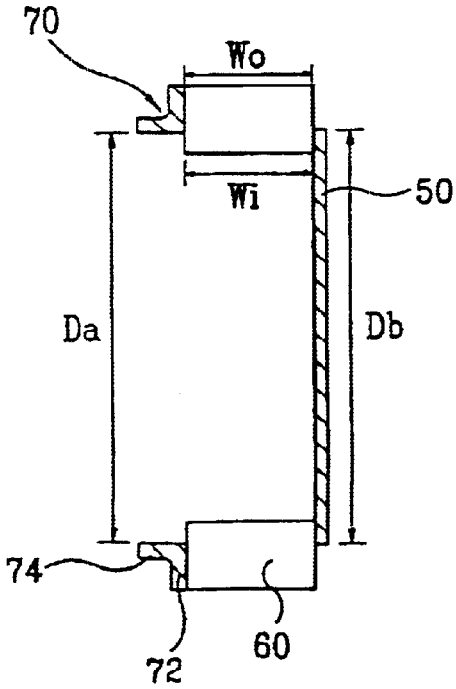
FIG. 12 illustrates a section of a turbofan for use in a window air conditioner in accordance with a third preferred embodiment of the present invention.

A turbofan in a window air conditioner in accordance with a third preferred embodiment of the present invention will be explained with reference to FIG. 12. FIG. 12 illustrates a section of a turbofan for use in a window air conditioner in accordance with a third preferred embodiment of the present invention.

Figure 1:
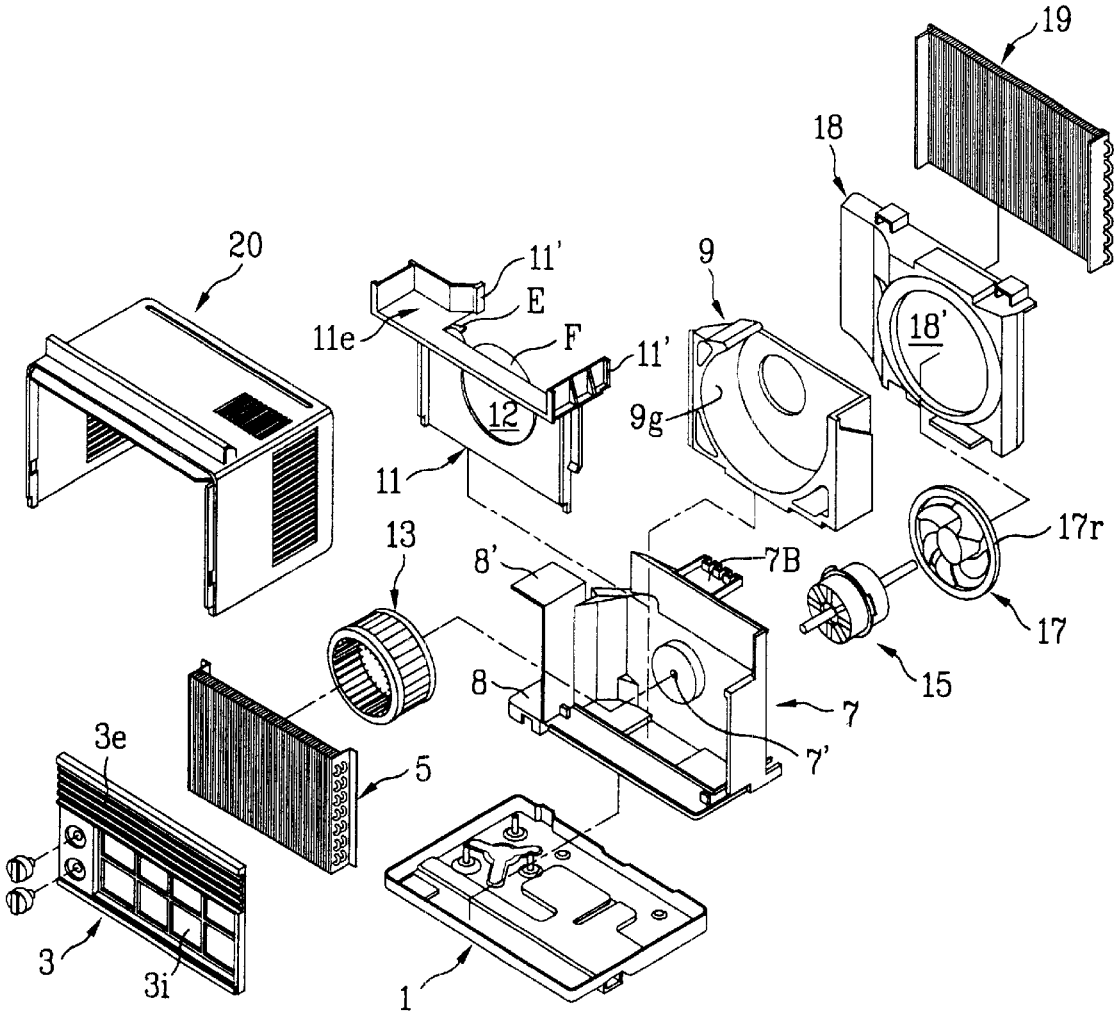
FIG. 1 Related Art
FIG. 1 illustrates a perspective disassembled view of a related art window air conditioner.
Figure 2:
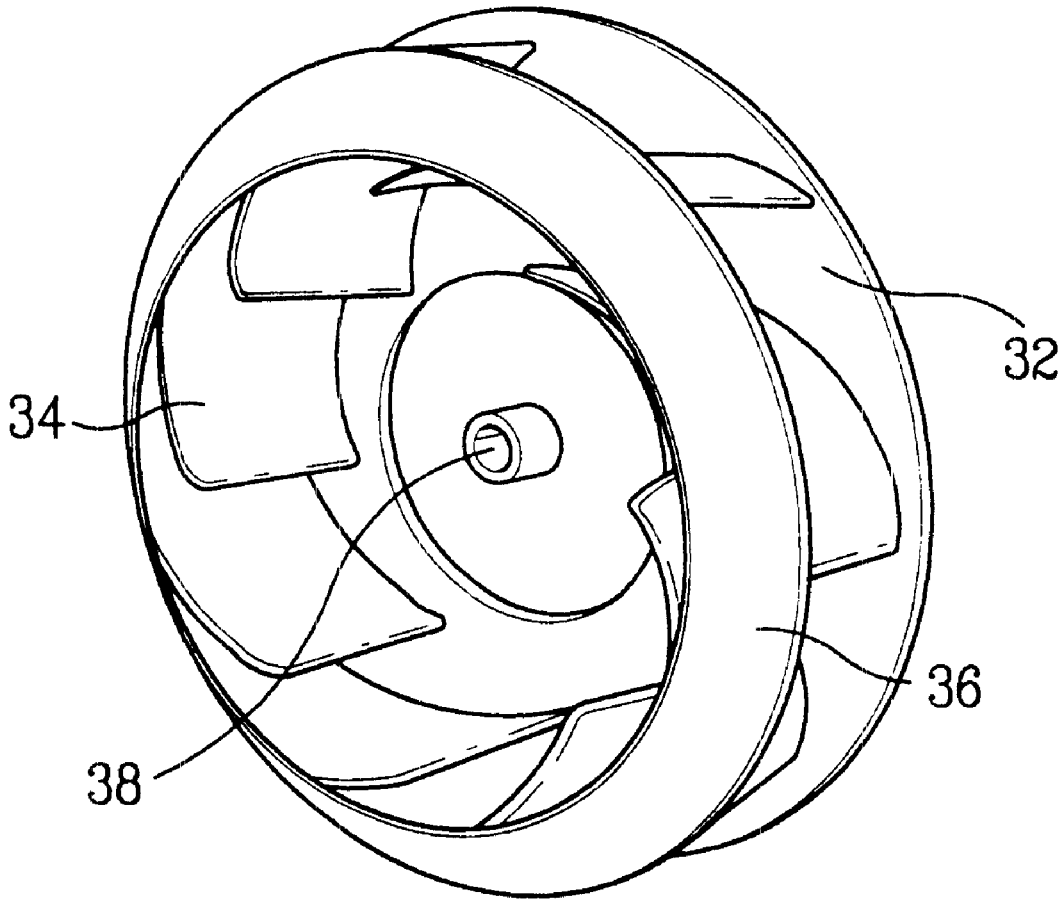
FIG. 2 Related Art
FIG. 2 illustrates a perspective view of a related art turbofan for use in a window air conditioner.
Figure 3A:
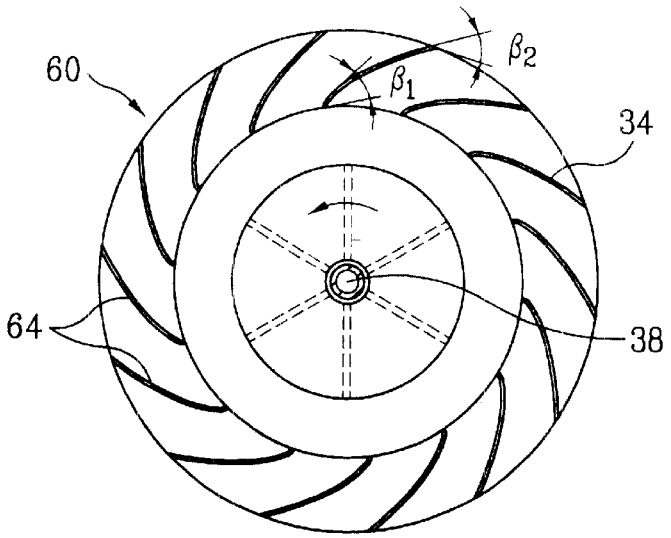
FIG. 3A Related Art
FIG. 3A illustrates a front view of the related art turbofan in FIG. 2.
Figure 3B:
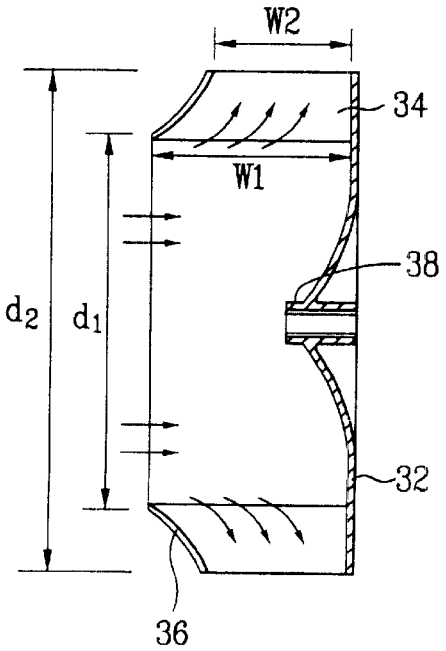
FIG. 3B Related Art
FIG. 3B illustrates a sectional view of the related art turbofan in FIG. 2.
Figure 4:
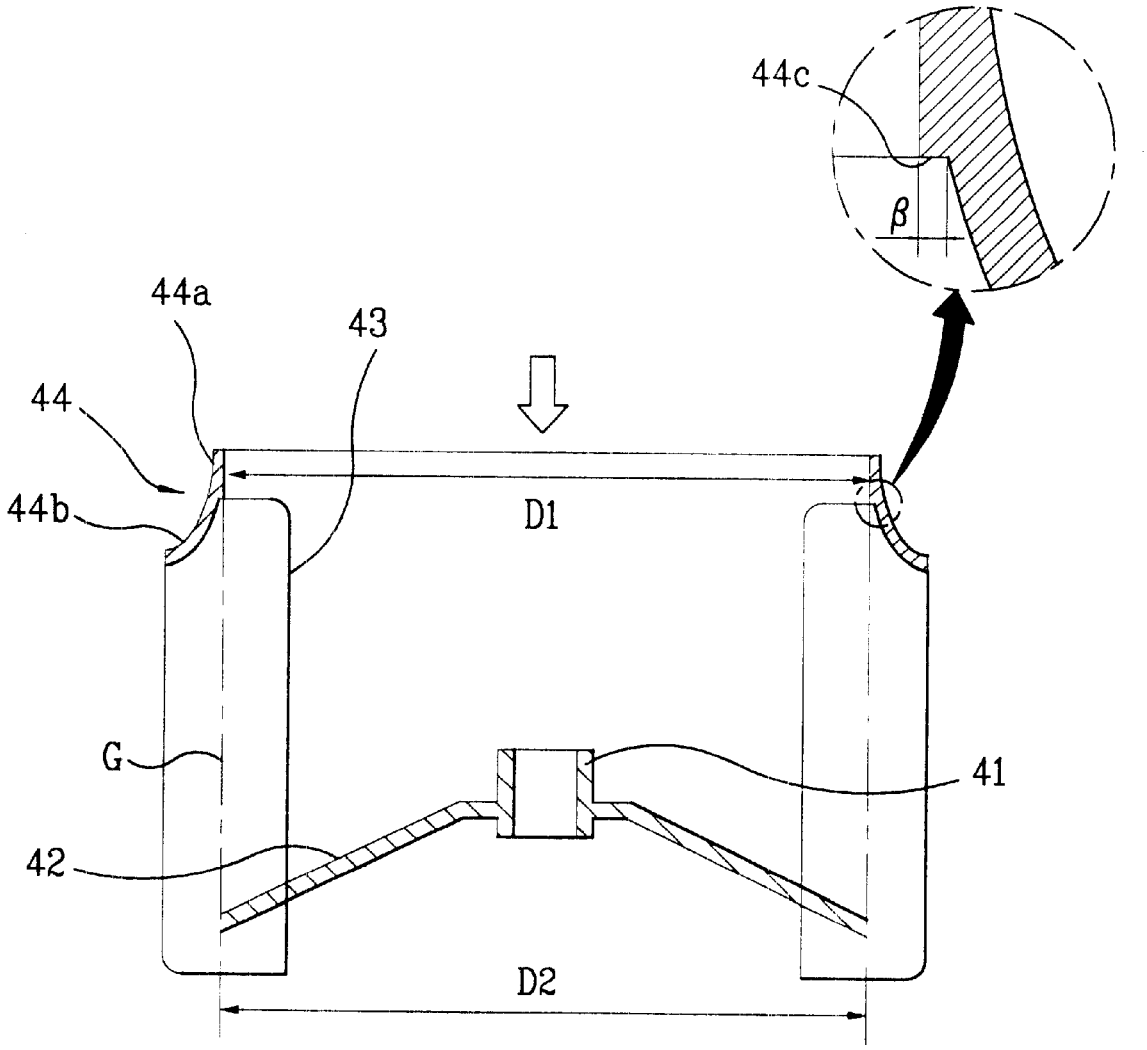
FIG. 4 related Art
FIG. 4 illustrates another example of a related art turbofan.
Figure 5:
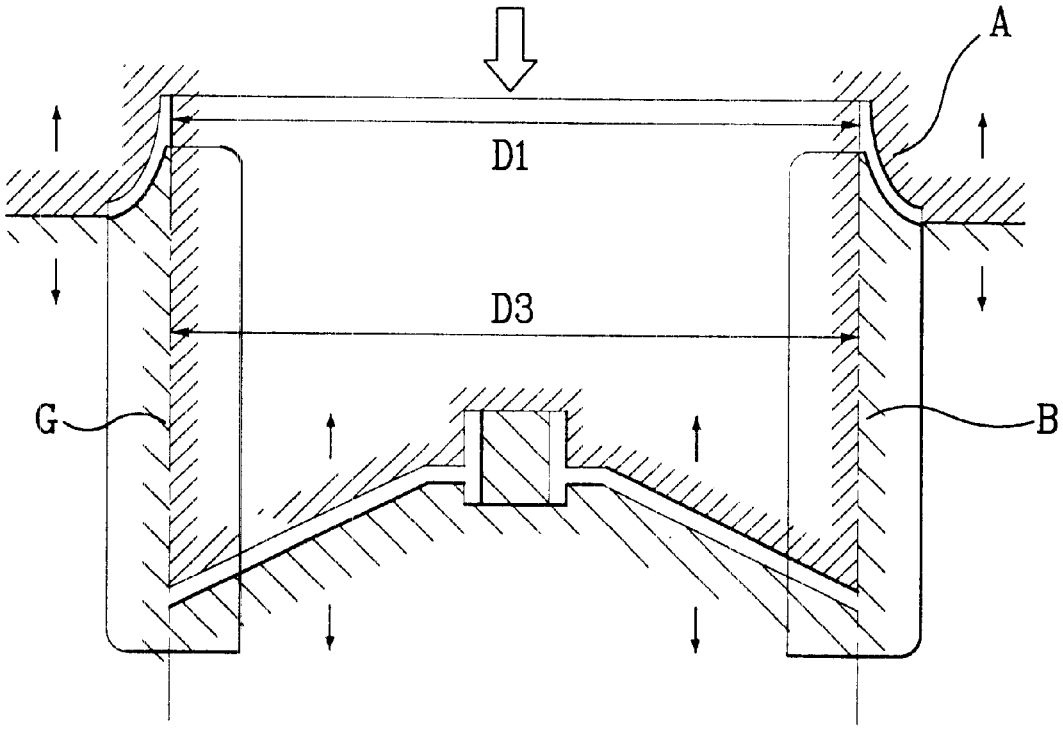
FIG. 5 Related Art
FIG. 5 illustrates a section of a turbofan for explaining a state the turbofan is formed in a mold.
Figure 6:
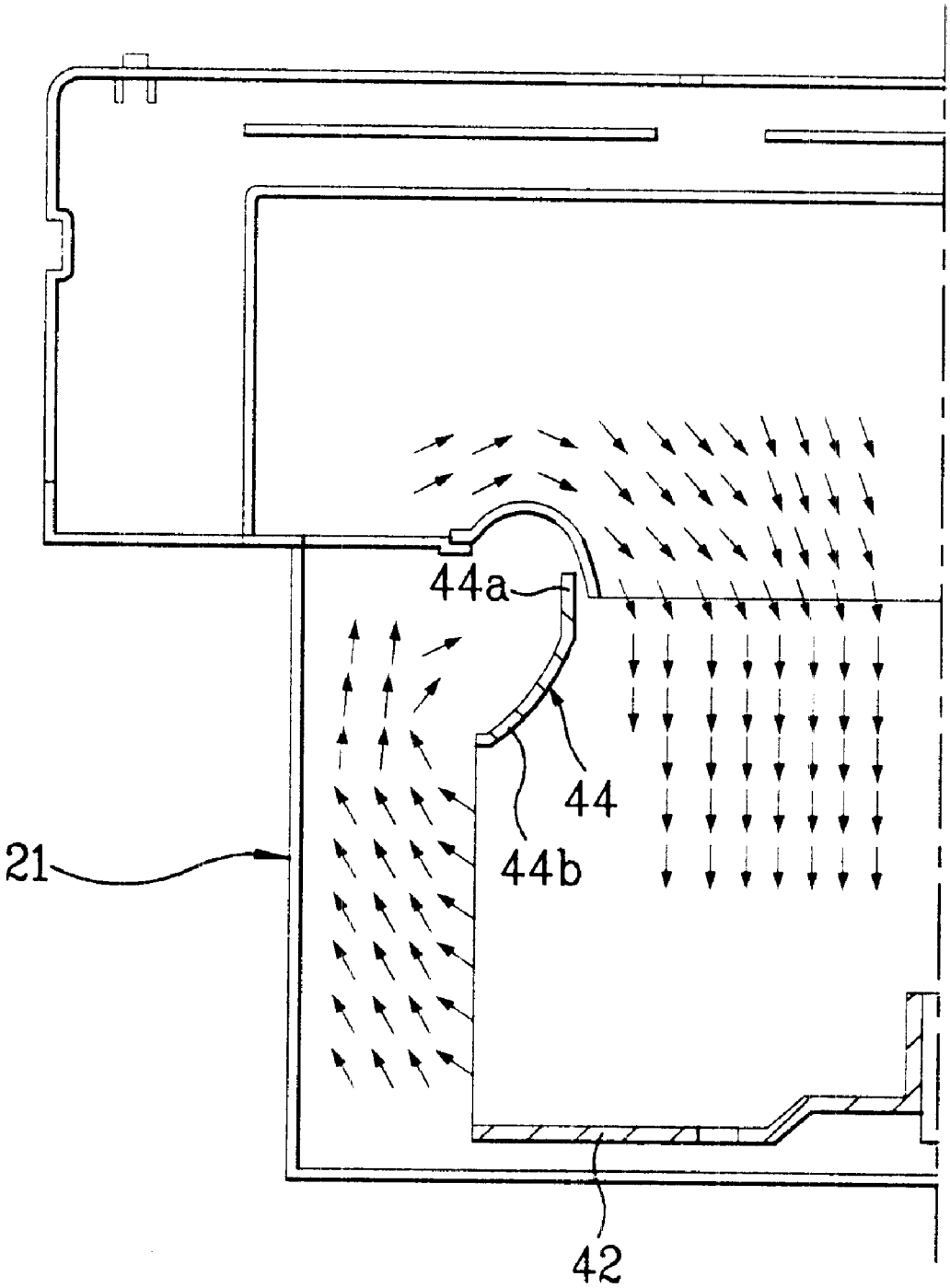
FIG. 6 Related Art
FIG. 6 illustrates a section showing an air flow when the turbofan in FIG. 4 is applied.

Referring to FIG. 12, the turbofan in a window air conditioner in accordance with a third preferred embodiment of the present invention includes a base plate 50 having a hub at a center thereof for coupling to a shaft of a driving motor, a plurality of blades 60 each having identical inlet width Wi and outlet width Wo disposed at a periphery of the base plate 50 at fixed intervals along a circumferential direction, and a shroud 70 fitted to ends of the blades 60. Because the inlet width Wi and the outlet width Wo of the blade 60 are identical, a contact area ratio of the air with the blade 60 is the same from an inlet of the blade 60 to the outlet of the blade 60 when the air is discharged from a center part of the turbofan to outside of the turbofan (circumferential direction). The shroud 70 fitted to a turbofan front side end of each blade 60 includes a connecting part 72 for connecting a turbofan front side fore end of each blade 60, and a shoulder part 74 extended perpendicular to the connecting part 72 from an inside end of the connecting part 72 toward a front side of the turbofan. An inside end of the orifice 11 shown in FIG. 1 is inserted in an inside of the shoulder part 74, for minimizing air pressure loss introduced into the turbofan when the turbofan is in operation. The connecting part 72 of the shroud 70 may be connected to an entire, or only a part, of a fore end of the blade 60. In the turbofan in a window air conditioner in accordance with a third preferred embodiment of the present invention, an outside diameter Db of the base plate 50 is equal to, or smaller than an inside diameter Da of the shroud 70, permitting unitary injection molding of the turbofan. That is, making the outside diameter Db of the base plate 50 to be below the inside diameter Da of the shroud 70 is a provision for the unitary injection molding. If the base plate 50 and the shroud 70 have dimensions overlapped with the other, the unitary injection molding of the turbofan is not possible.

As has been explained, basically, the turbofan in a window air conditioner in accordance with a third preferred embodiment of the present invention suggests formation of the inlet, and outlet widths Wi and Wo of each of blades 60 fitted along one side circumferential surface of the base plate 50 are identical. Therefore, because inlet and outlet widths Wi and Wo of the blade 60 are formed identical in the third embodiment turbofan of the present invention, leading a flow area ratio identical when the air introduced into the turbofan flows from the inlet to the outlet of the blade 60, an air pressure from the inlet to outlet of the blade 60 is uniform. The uniform air pressure from the inlet to outlet of the rotating blade 60 implies that there is a pressure balance formed from the inlet to outlet of the blade 60, which suppresses an air flow noise to the maximum, allowing a quiet operation of the turbofan.

Moreover, the setting of the outside diameter Db of the base plate 50 to be below the inside diameter of the shroud 70 allows the unitary injection molding of the entire turbofan, an important component of the air conditioner is simpler, a defect ratio is minimzed, and a lifetime of the mold is prolonged as formation of the mold is easy and wear of the mold can be inhibited.

Figure 13:
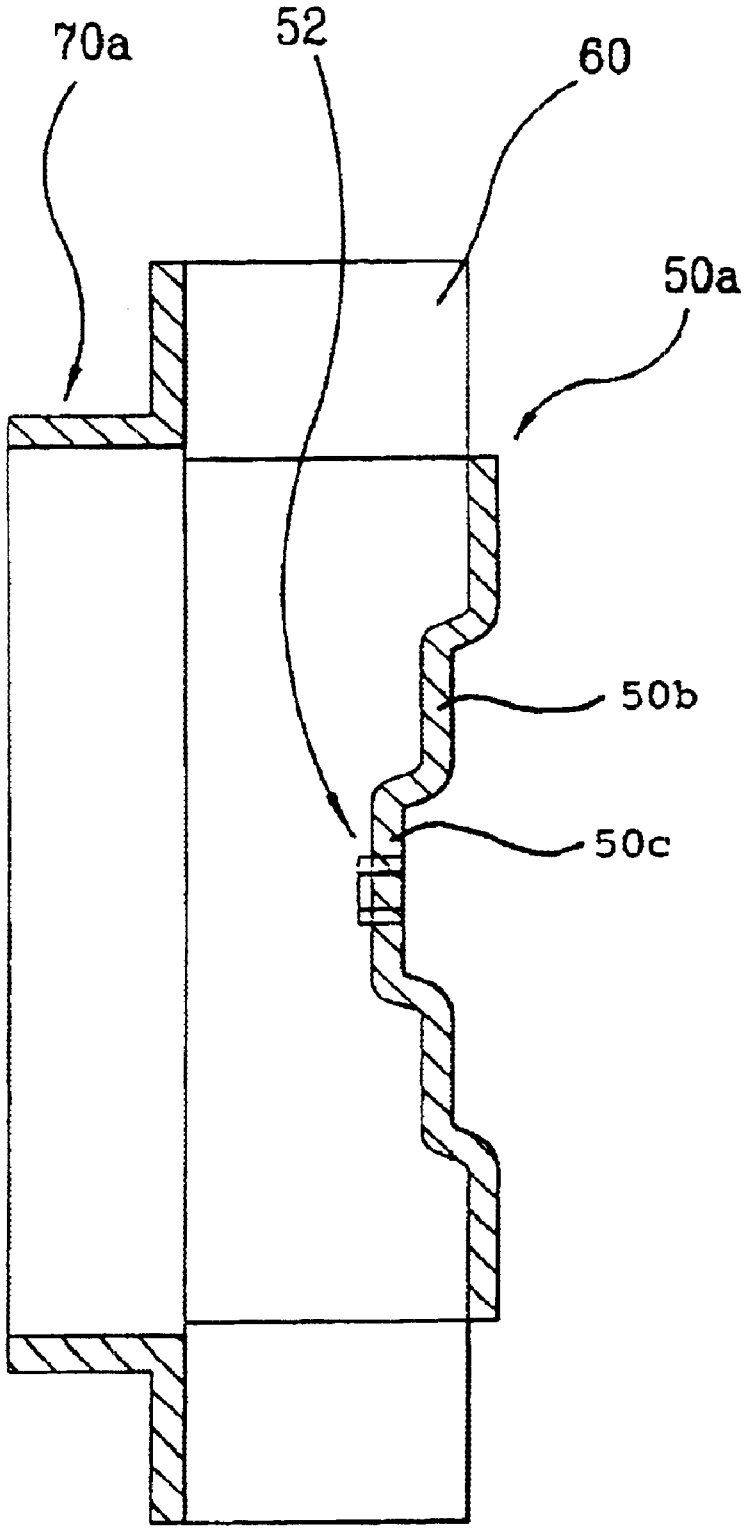
FIG. 13 illustrates a section of a turbofan for use in a window air conditioner in accordance with a fourth preferred embodiment of the present invention; and, FIGS. 14A and 14B illustrate sections of blades applicable to the embodiments of the present invention.

A turbofan in a window air conditioner in accordance with a fourth preferred embodiment of the present invention will be explained, with reference to FIG. 13. FIG. 13 illustrates a section of a turbofan for use in a window air conditioner in accordance with a fourth preferred embodiment of the present invention, wherein a form of the base plate 50*a* in the third embodiment is modified. The base plate 50*a* has a hub 52 to be coupled with a shaft of the motor at a center thereof. The hub 52 is formed at the center of the base plate 50*a* which is projected forward toward the shroud 70*a* in two stages, e.g., having a first stepped portion 50*b* and a second stepped portion 50*c*. The two stage projection of the base plate 50*a* to a shroud side 70*a* permits a reduction of a shaft direction width of the turbofan and the motor, providing a larger space for adjacent components, and giving more freedom for arranging and designing the adjacent components. The embodiment also permits an easy formation of the mold, and inhibits wear, to prolong a lifetime of the mold. Along with this, as the hub 52 balancing the turbofan is positioned near to the center of the turbofan in a shaft direction, dismantling of the mold is easy during the formation of the turbofan, and vibration and noise caused by eccentricity is reduced during operation of the turbofan.

Figure 14A:
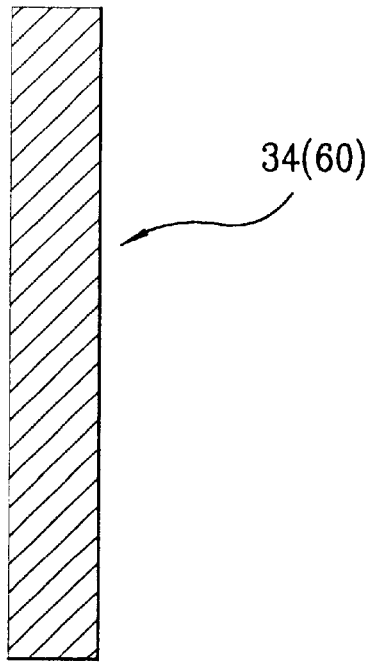
Figure 14B:
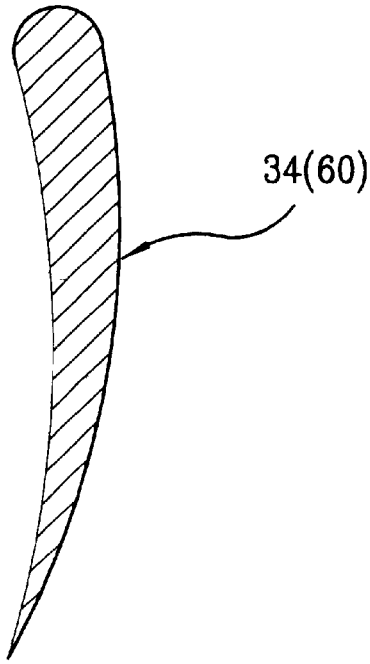

FIGS. 14A and 14B illustrate sections of blades applicable to the embodiments of the present invention. The blades 40 and 60 of the turbofan in different embodiments of the present invention may have a streamlined section as shown in FIG. 14A, or a simple planar section as shown in FIG. 14B.

As has been explained, the turbofan in a window air conditioner of the present invention has the following advantages. Unitary formation of a turbofan is facilitated to minimize a ratio of defects occurring in formation of the turbofan and to improve productivity, an easy formation of a turbofan mold is made possible, and a lifetime of the mold is prolonged. Vibration and noise occurring during operation of the turbofan can be minimized.

It will be apparent to those skilled in the art that various modifications and variations can be made in the turbofan in an air conditioner of the present invention without departing from the spirit or scope of the invention. Thus, it is intended that the present invention cover the modifications and variations of this invention provided they come within the scope of the appended claims and their equivalents.

What is claimed is:

1. A turbofan comprising:

a base plate having a hub at a center thereof for coupling to a shaft of a driving motor;

a plurality of blades disposed at a periphery of the base plate at fixed intervals along a circumferential direction; and a shroud including an inlet side end part formed in parallel to the shaft, and fitted to ends of the blades to connect the ends, having an inside diameter equal to, or greater than an outside diameter of the base plate, a shoulder part extended outward in a radial direction from an inside circumference of the inlet side end part, and a sloped part extended outward in a radial direction, and sloped downward, from an end of the shoulder part.

2. The turbofan according to claim 1, wherein the base plate includes a central part having the hub formed like a cap so that the central part is disposed closer to an inlet compared to a bottom part thereof on an outer side of the central part, and a connecting part between the central part having the hub and the bottom part having a plurality of openings along a circumference thereof.

3. The turbofan according to claim 1, wherein the connecting part is parallel with a direction of the shaft, wherein a part where the central part and the connecting part meet is curved.

4. The turbofan according to claim 1, wherein the shoulder part has at least a 4 mm width.

5. A turbofan comprising:

a base plate having a hub at a center thereof for coupling to a shaft of a driving motor;

a plurality of blades disposed on an outside circumferential end surface of the base plate at fixed intervals along a circumferential direction, wherein the outside circumferential end surface of the base plate fitted to an inside surface of the blades is fitted to the blades in a state in which the outside circumferential end surface of the base plate is bent forward or backward with respect to an axial direction of the turbofan; and a shroud fitted to ends of the blades, the shroud having an inside diameter larger than an outside diameter of the base plate.

6. The turbofan according to claim 5, wherein the outside circumferential end surface of the base plate is bent forward or backward of the turbofan by 90°.

7. The turbofan according to claim 5, wherein the inside surfaces of the blades fitted to the shroud are positioned nearer to a center side of the turbofan than an inside circumference of a fore end of the shroud.

8. A turbofan comprising:

a base plate having a hub at a center thereof for coupling to a shaft of a driving motor;

a plurality of blades each having identical inlet widths and outlet widths disposed at a periphery of the base plate along a circumferential direction; and a shroud fitted to ends of the blades, the shroud having an inside diameter larger than an outside diameter of the base plate, wherein the shroud includes a connecting part for connecting a turbofan front side fore end of each blade, and a shoulder part extended perpendicular to the connecting part from an inside end of the connecting part toward a front side of the turbofan.

9. The turbofan according to claim 8, wherein the connecting part of the shroud is fitted to an entire fore end of the blade.

10. The turbofan according to claim 8, wherein the connecting part of the shroud is fitted only to a part of the fore end of the blade.

11. A turbofan comprising:

a base plate including a first portion projecting forward toward a shroud side at a center thereof, a second portion projecting forward toward the shroud side at a center of the first portion, and a hub projected at a center of the second portion for coupling to a shaft of the driving motor;

a plurality of blades each having identical inlet widths and outlet widths disposed at a periphery of the base plate at fixed intervals along a circumferential direction; and a shroud fitted to ends of the blades.

12. The turbofan according to claim 11, wherein the blade has a streamlined or planar section.

13. A window air conditioner comprising:

an outdoor heat exchanger and an indoor heat exchanger, said heat exchangers being arranged within an air conditioning cycle;

a turbofan, said turbofan including a condenser;

a base plate having a hub at a center thereof for coupling to a shaft of a driving motor;

a plurality of blades disposed at a periphery of the base plate at fixed intervals along a circumferential direction; and a shroud including an inlet side end part formed in parallel to the shaft, and fitted to ends of the blades to connect the ends, having an inside diameter equal to, or greater than an outside diameter of the base plate, a shoulder part extended outward in a radial direction from an inside circumference of the inlet side end part, and a sloped part extended outward in a radial direction, and sloped downward, from an end of the shoulder part.

14. The air conditioner according to claim 13, wherein the base plate includes a central part having the hub formed like a cap so that the central part is disposed closer to an inlet compared to a bottom part thereof on an outer side of the central part, and a connecting part between the central part having the hub and the bottom part having a plurality of openings along a circumference thereof.

15. The air conditioner according to claim 13, wherein the connecting part is parallel with a direction of the shaft, wherein a part where the central part and the connecting part meet is curved.

16. The air conditioner according to claim 13, wherein the shoulder part has at least a 4 mm width.

* * * * *